United States Patent [19]

Galperin et al.

[11] 3,991,794

[45] Nov. 16, 1976

[54] WEFT THREAD SHUTTLE FOR TRAVELLING WAVE SHEDDING LOOMS

[76] Inventors: Alexandr Lvovich Galperin, ulitsa Moldagulovoi, 10, korpus 2, kv. 166, Moscow; Evgeny Dmitrievich Loschilin, Kashirskoe shosse, 36, kv. 87, Domodedovo Moskovskoi oblasti; Eduard Arshakovich Onikov, ulitsa Panferova, 5, korpus 2, kv. 106, Moscow; Alexandr Alexandrovich Zabotin, Profsojuznaya ulitsa, 96, kv. 85, Moscow; Boris Alexandrovich Sakharov, ulitsa Krzhizhanovskogo, 24/35, korpus 6, kv. 404, Moscow, all of U.S.S.R.

[22] Filed: Jan. 5, 1976

[21] Appl. No.: 646,416

Related U.S. Application Data

[63] Continuation of Ser. No. 520,477, Nov. 4, 1974, abandoned.

[30] Foreign Application Priority Data

Nov. 26, 1973 U.S.S.R. ..... 1971638

[52] U.S. Cl. ..... 139/196.3

[51] Int. Cl.[2] ..... D03D 47/26; D03J 5/00

[58] Field of Search..... 139/436, 196.1, 196.3

[56] References Cited

UNITED STATES PATENTS

| | | | |
|---|---|---|---|
| 3,766,950 | 10/1973 | Vasek et al. | 139/436 |
| 3,848,641 | 11/1974 | Zabrodsky et al. | 139/436 |

*Primary Examiner*—Henry S. Jaudon
*Attorney, Agent, or Firm*—Lackenbach, Lilling & Siegel

[57] ABSTRACT

A weft thread shuttle for travelling-wave shedding looms, wherein the shuttle is moved in a shed independently of the beating-up mechanism. This shuttle has a bevel tip, a spool with the weft thread and means for tensioning the thread laid-in in the shed facing the beating-up mechanism for beating it up to the fell of fabric. The side wall of the shuttle facing the beating-up mechanism is arranged at an acute angle to an imaginary line extending in parallel with the direction of movement of the shuttle in the shed, and is smoothly conjugated with the surface of the tip and has a height gradually increasing from the tip to the rear wall of the shuttle. This construction of the shuttle permits to eliminate the appearing looping without stopping the loom.

4 Claims, 6 Drawing Figures

WEFT THREAD SHUTTLE FOR TRAVELLING WAVE SHEDDING LOOMS

This is a continuation of application Ser. No. 520,477, filed Nov. 4, 1974 (now abandoned).

The present invention relates to travelling-wave shedding looms having a beating-up mechanism and means for displacing weft thread shuttles in a shed, and in particular to weft thread shuttles of such looms.

At present, weft thread shuttles for a travelling-wave shedding loom are known c.f. French Pat. No. 2090879, wherein the shuttles are moved along the beating-up mechanism by an individual drive.

The body of each of the shuttles is of a trapezoidal cross-section and comprises a rear wall, a pair of side walls extending in parallel with the beating-up mechanism, and a tip of a conical shape conjugated with the two side walls with a manifest boundary therebetween. The body of the shuttle is provided, adjacent to the rear wall thereof, with a cavity accommodating a spool with the weft stock. In the zone of conjugation of the rear wall with the side walls there is provided means for tensioning the weft thread which is laid-in in the shed and faces the beating-up mechanism for beating it up to the fell of fabric.

In such a loom, the beating-up mechanism comprises a rotary shaft on which there are mounted disks turned relative to each other, each having a recess for accommodating the weft thread and teeth for beating the weft up thread to the fell of fabric.

During the operation of such a loom there may occur a situation in which the weft thread cannot be engaged in the recesses of the disks. In this case the thread paid-off from the shuttle spool will run in parallel with the beating-up mechanism, while the disk teeth will space the thread away from the beating-up mechanism at a still greater distance.

Thus, the weft thread is positioned in the path of movement of the next shuttle to interfere with its passage. Since the next shuttle moves in a different shed, the weft thread from the preceeding shuttle, which is not engaged by the beating-up mechanism, will be interlaced with the warp threads thereby resulting in the formation of looping so that the shed is reduced to a size which is much smaller than that required for the passage of the next shuttle.

Upon entrance of the shuttle into such a reduced shed, its tip widens the warp threads at the first instant to enlarge, to some extent, the shed size, but as the shuttle penetrates further into the shed, it acts on the warp threads only by the edge at the conjugation of its tip with the side wall facing the beating-up mechanism.

As a result, a considerable force is developed which is applied to the threads and can be resolved into two components, one of the force components acting on the warp threads normally thereto is substantially greater than the other force component applied to the weft thread in parallel with the warp threads. This results in a shift of the warp threads from their initial position so that they are elongated, while their distribution among the disks of the beating-up mechanism is changed thereby modifying the density of the fabric being formed in this zone and breaking the weft or warp threads.

In order to prevent the breakage of threads or the formation of undergrade fabric, the loom should be stopped to eliminate the looping, and for that purpose the loom must be provided with a device for indication of the presence of looping and means for rapidly stopping the loom. The employment of such devices complicates, however, the loom construction and requires, in addition, the provision of auxiliary means for connecting such devices to the loom drive.

Rapid stoppage of the loom results in wear and failure of those parts which have a large mass, such as a device for winding the weft thread on spools. This can be avoided only by gradually arresting the whole loom and rapidly interrupting the movement of the weft thread shuttle because it has a considerably smaller mass. However, this will result in a delay of operation of the shuttle within the production cycle with respect to other mechanisms of the loom so that some adjustments of the loom will be necessary to restore normal operation of the loom. Furthermore, the stoppage of the loom for elimination of looping considerably reduces the productivity of loom.

It is an object of the present invention to provide a weft thread shuttle for travelling-wave shedding looms which has a configuration such as to ensure the displacement of the weft thread, which is not engaged by the beating-up mechanism, for subsequent beating of that weft thread up to the fell of fabric together with a new weft thread, whereby the defect thus appearing can be eliminated without stopping the loom, while the productivity of the loom and quality of the fabric formed therein can also be improved.

With these and other objects in view, in a weft thread shuttle for travelling-wave shedding looms comprising a body of a trapezoidal cross-section which is moved along the beating-up mechanism of the loom and has a bevel tip conjugated with side walls thereof, a spool with the weft thread and means for tensioning this thread laid-in in the shed facing the beating-up mechanism for beating it up to the fell of fabric, according to the invention, the side wall of the body facing the beating-up mechanism is arranged at an acute angle to an imaginary line extending in parallel with the direction of movement of the shuttle in the shed, is smoothly conjugated with the surface of the bevel tip and gradually increases in height from the tip to the rear wall of the body.

The arrangement of the side wall of the shuttle at an acute angle to an imaginary line extending in parallel with the direction of movement of the shuttle, and respectively, to the beating-up mechanism permits action on the warp threads with this side wall upon the appearance of looping accompanied by the shed reduction.

Since the side wall is arranged at an acute angle, and the endmost point thereof is brought as close as possible to the beating-up mechanism, during the penetration of the shuttle into the reduced shed, the warp threads are widened to enlarge the shed size, and at every next instant a new portion of the edge of this side wall acts on the warp threads. Accordingly, in each of such portions there is developed a force which is resolved into two component forces, of which one acts on the warp threads normal thereto and is considerably smaller than the other which acts on the weft threads through the warp threads in parallel with the warp threads. The weft thread interlaced with the warp threads will be displaced under the action of the latter force component towards the beating-up mechanism, and the warp threads will be laterally displaced at a small angle within admissible limits, whereby their misalignment, and hence, a modified distribution among the disks of the beating-up mechanism are prevented. Therefore, there are no conditions for breakage of the weft or warp threads or for impairing the density of the fabric being manufactured.

Gradual increase of height of the side wall from the tip to the rear wall of the body permits a progressive enlargement of the reduced shed during the entrance of the shuttle therein, and upon an increase in the size of the shed, the weft threads, passing around the wall of the shuttle, whose height gradually increases, are considerably flexed, whereby the thread tensioning also increases. Since the warp threads are strongly tensioned, they tend to straighten under the action of elastic forces appearing as a result of flexing of the threads so that the weft thread located therebetween will be displaced under the action of these forces towards the beating-up mechanism.

During this displacement, the weft thread, while moving towards the beating-up mechanism, is received in the recesses of the disks thereof and is then moved to the fell of fabric.

Smooth conjugation of the surface of the bevel tip with the side wall facing the beating-up mechanism prevents the edge at this conjugation from acting on the warp threads, whereby the predominance of forces acting on the warp threads normally thereto is completely eliminated.

The invention is further characterized in that the angle of inclination of the side wall to the imaginary line extending in parallel with the direction of movement of the shuttle does not exceed 45°, because otherwise considerable forces may appear to displace the warp threads from their initial position which results either in breakage or in a redistribution thereof among the disks of the beating-up mechanism.

The invention is also characterized in that the side wall of the body facing the beating-up mechanism is smoothly conjugated with the surface of the bevel tip defines a unique convex line whose convexity faces the beating-up mechanism. This provides the most favourable conditions for displacing the weft thread, which is not engaged by the beating-up mechanism, and allows for more compact arrangement of the spool for the weft thread and means for tensioning thereof in the shuttle.

Therefore, the weft thread shuttle according to the invention permits substantially improved the productivity of loom and quality of the fabric being manufactured. In addition, in using the shuttles according to the invention, there is no need in stopping the loom to eliminate looping, since the weft thread from a preceeding shuttle, which is not engaged by the beating-up mechanism, will be displaced by the next shuttle towards the beating-up mechanism which will transfer this weft thread to the fell of fabric, thereby eliminating the possibility of formation of less heavily wefted fabric. Thus, the process of the fabric formation is restored along the entire length of the loom without stopping it.

The invention will now be described in details with reference to a specific embodiment of a weft thread shuttle for a travelling-wave shedding loom according to the invention illustrated in the accompanying drawings, in which.

Figure 6:
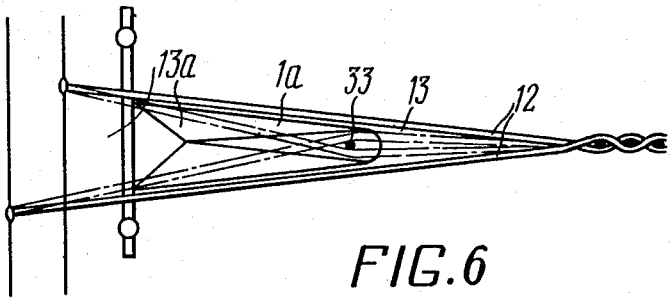

FIG. 6 diagrammatically shows the position of the warp threads during the normal fabric formation process and upon occurence of looping.

The weft thread shuttle according to the invention (FIGS. 1 and 2) is used in known travelling-wave shedding looms, wherein the beating-up mechanism A comprises a rotary shaft 2 (FIG. 1) provided with disks mounted thereon, each disk having a recess 4 for accommodation of the weft thread and teeth 5 effecting the beating of the weft thread up to the fell 6 of fabric 7. The disks 3 are turned relative to each other in such a manner that the recesses 4 and teeth 5 define helical lines 8 and 9, respectively.

The shuttle 1 is moved along the beating-up mechanism A by means of a conventional endless chain conveyor 10 accommodated in a recess of a closed-loop guide 11. A part of this chain conveyor 10, together with the guide 11 is located over the formed fabric 7, and another portion is located under warp threads 12 forming a shed 13. The chain conveyor 11 comprises a conventional roller-and-bush consisting of interconnected links provided with stops 14 holding the shuttles during their movement outside the shed 13 along the guide 11, as well as with rollers 15 providing the movement of the shuttles 1 in the shed 13.

Figure 3:
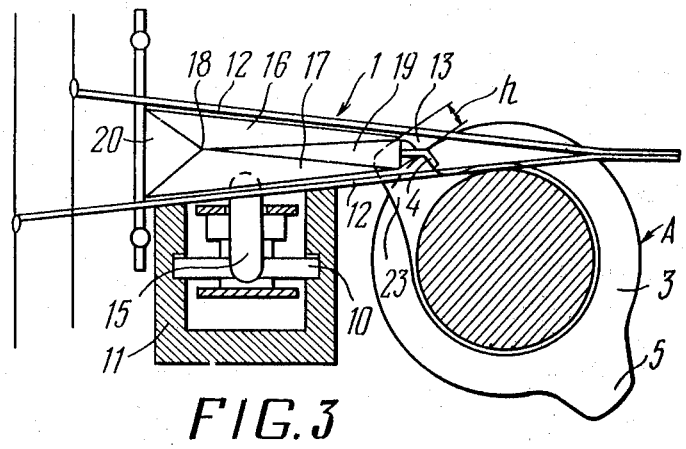
FIG. 3 shows the position of the shuttle in a normal shed and the position of the beating-up disks at the instant of engagement of the weft thread leaving the shuttle in a front elevation view.
Figure 4:
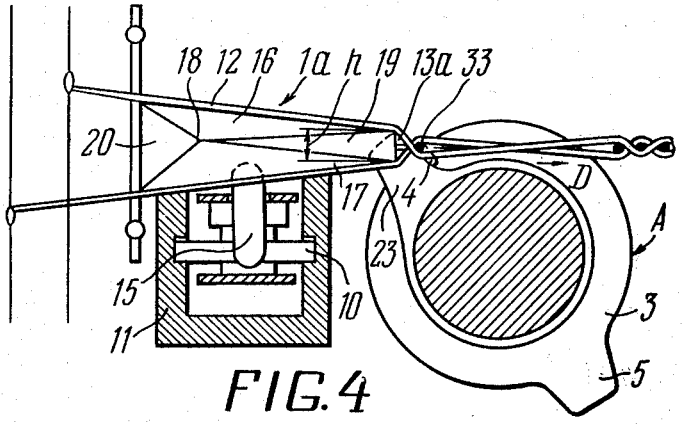
FIG. 4 shows a view similar to that shown in FIG. 3, but for the case of appearance of looping.

The shuttle 1 comprises a hollow body of a trapezoidal cross-section as shown in FIGS. 3 and 4.

Figure 5:
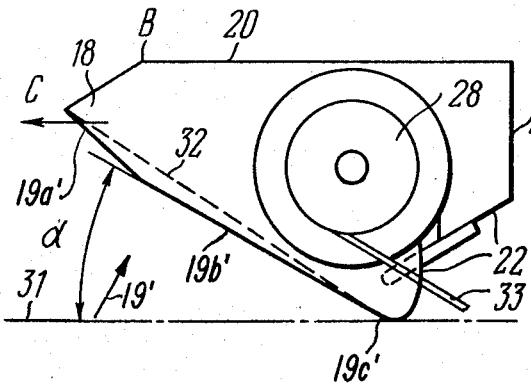
FIG. 5 shows another embodiment of the shuttle in a plan view.

The body has a top side 16 and a bottom side 17, a rear wall 21 (FIG. 5), and a bevel tip 18 (FIG. 5) smoothly conjugated with side walls 19 and 20 (FIGS. 3 and 4) and with the top and bottom sides 16 and 17. The smooth conjugation of the tip 18 is necessary with the side wall 19 facing the beating-up mechanism and is optional with the side wall 20 located oppositely with respect to the beating-up mechanism as shown in FIG. 5 so that a manifest edge B at the point of conjugation is clearly seen. In the zone between the side wall 19 and the rear wall 21 there may be provided a cavity 22 for receiving engaging teeth 23 (FIG. 1) of intermediate disks 24 disposed inbetween the disks 3 during the movement of the shuttle.

A through hole 25 in the body to receive the stop 14 for holding the shuttle during the movement outside the shed 13, and a recess 26 receiving the roller 15 propelling the shuttle during its movement in the shed 13.

The top side 16 of the shuttle body is provided with a recess 27 (FIG. 1) having a hollow axle fixed at the centre thereof for mounting thereon a spool 28 with the weft stock. Furthermore, mounted on the same top side 16 adjacent to the rear wall is means 29 for tensioning the weft thread paid-off from the spool 28 and laid-in in the shed 13 in face of the beating-up mechanism A for beating it up by this mechanism to the fell 6 of fabric 7.

Figure 2:
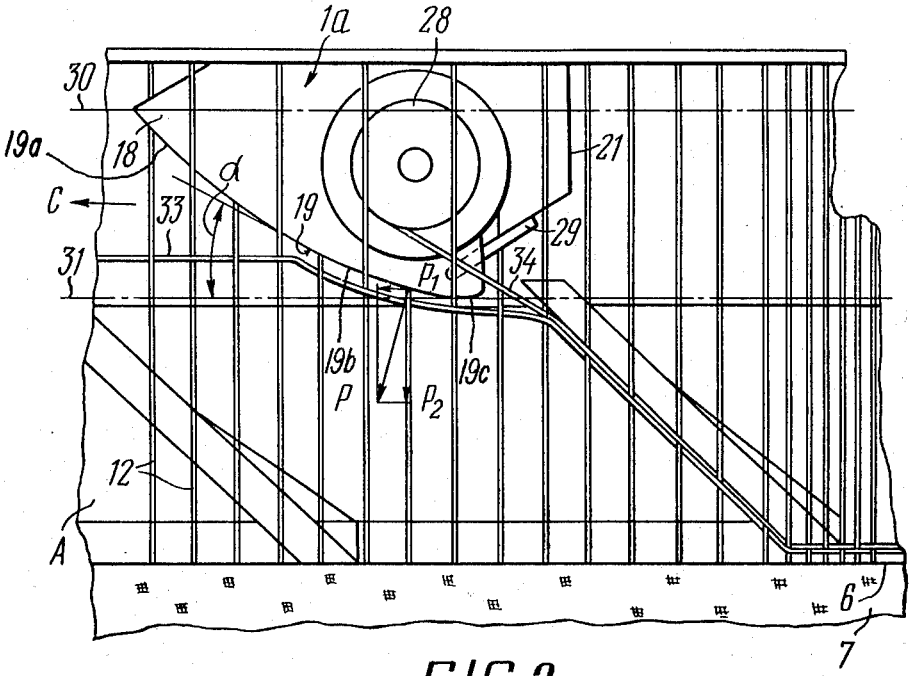
FIG. 2 is a plan view of a shuttle displacing an interlaced weft thread, the warp threads forming the shed being shown in a fewer number than those closing the shed, for the sake of clarity.

Means 29 is spaced apart from the beating-up mechanism A at a distance which is not greater than the similar spacing of the tip 18, that is it is located in the zone between the side wall 19 with the rear wall 21 and an imaginary line 30 (FIG. 2) drawn through the tip coinciding with the direction of movement of the shuttle in the shed shown by arrow C in FIG. 2 and parallel with the beating-up mechanism A. Means 29 may comprise any devices known in the art used for this purpose, such as plates springly biased to the body, the weft thread extending therebetween.

The side wall 19 of the body facing the beating-up mechanism A is arranged at an acute angle $\alpha$ to an imaginary line 31 extending in parallel with the direction of movement of the shuttle in the shed, that is at an acute angle to the beating-up mechanism A. The angle $\alpha$ (FIG. 5) of inclination of the side wall 19 to the imaginary line 31 does not exceed 45°. Thus, the side wall 19 is formed by a straight line conjugated with the surface of the tip 18, or the surface of the tip 18 and the side wall 19 define a unique line 32 shown with dotted line in FIG. 5. The angle $\alpha$ may be equal to 45° or less. It should be noted that the side wall 19 and the surface of the tip 18 smoothly conjugated therewith may be made as a unique convex curve as shown in FIGS. 1 and 2 whose convexity faces the beating-up mechanism A, the angle $\alpha$ between the curve and the imaginary line 31, diminishing in the direction from the tip 18 to the rear wall 21 beginning with 45° down.

Figure 1:
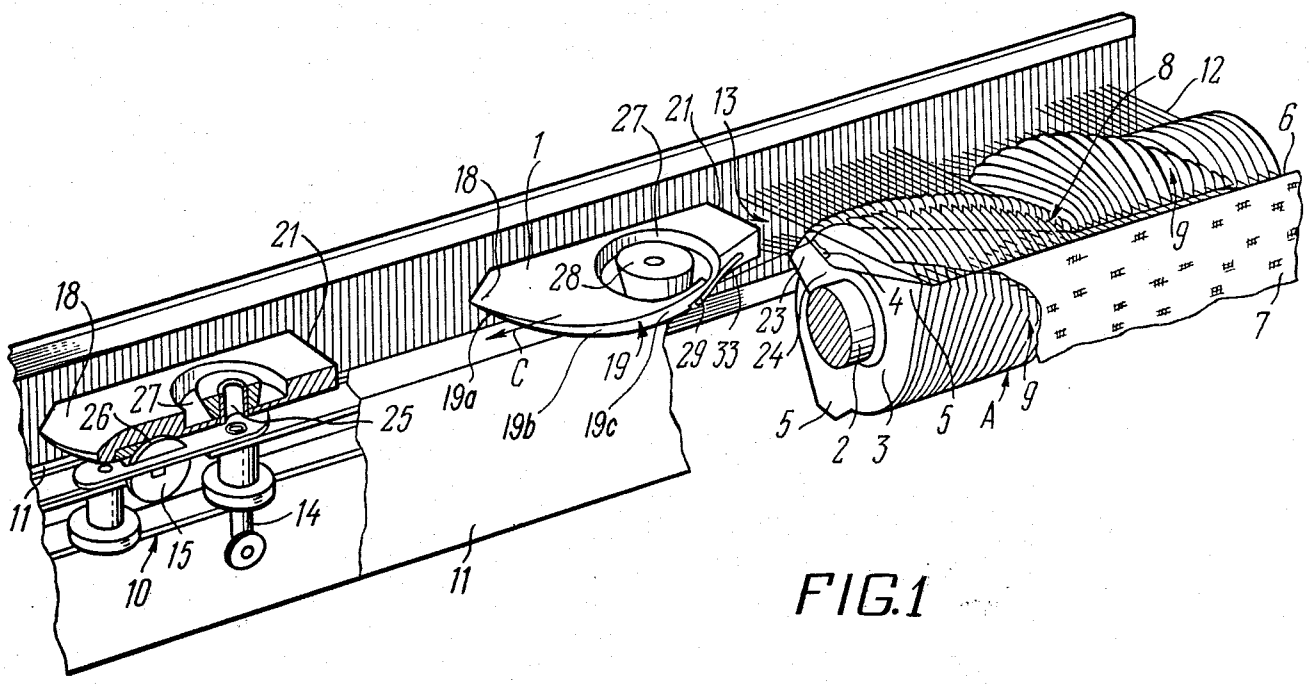
FIG. 1 shows weft thread shuttles movable in the shed and a beating-up mechanism.

More specifically, as is clearly evident from the FIGS. 1 and 2, the side wall 19 facing the beating-up mechanism A has leading and trailing surface portions 19*a* and 19*b* respectively with respect to the direction of movement of the weft thread shuttle 1. As best shown in FIG. 2, the distance between the side wall 19 and the beating-up mechanism A gradually decreases from the tip 18 towards the rear wall 21, the side wall 19 having the smallest spacing from he beating-up mechanism A at an intermediate portion 19*c* of the weft thread shuttle 1. The portion 19*c* forms part of the trailing portion 19*b* of the side wall 19 and marks the beginning of the cavity 22 which extends between the portion 19*c* and the rear wall 21.

When the side wall 19 is a convex curve or is continuously curved, the leading and trailing surface portions 19*a* and 19*b* are each curved and are smoothly conjugated with each other to define continuously smaller acute angles $\alpha$ with respect to the imaginary line 31 starting at the tip 18 and terminating at the portion 19*c*.

With respect to FIG. 5, the leading the trailing surface portions 19*a'* and 19*b'* of the side wall 19' are each straight and define, along the entire lengths thereof, constant acute angles with respect to the imaginary line 31. As with the embodiment shown in FIGS. 1 snd 2, the trailing surface portion 19*b'* defines a smaller angle $\alpha$ than does the leading surface portion 19*a'*. The intermediate portion 19*c'* is the closest to the beating-up mechanism A and marks the beginning of the cavity 22.

Therefore, the weft thread shuttle 1 of the present invention has, in each case, leading and trailing surface portions, 19*a* and 9*b* (or 19*a'* and 19*b'*) respectively which face the beating-up mechanism A and are respectively arranged at greater and smaller acute angles $\alpha$ with respect to the imaginary line 31. The surface portions may be curved (19*a* and 19*b* in FIGS. 1 and 2) or straight (19*a'* and 19*b'* in FIG. 5). In all cases, however, the angles decrease, at least once, between the tip 18 and the intermediate portion 19*c* (or 19*c'*). While the side wall 19' is formed by two straight portions 19*a'* and 19*b'*, the curved side wall 19 represents an infinite number of infinitesimally small straight surfaces each successive one of which has a slightly smaller angle $\alpha$ as it is more closely spaced to the intermediate portion 19*c*.

As shown in FIGS. 3 and 4, the tip 18 is illustrated as a point at which the disc walls 19 and 20, as well as the bottom and top sides 17 and 16 begin, and it will be seen from these Figures that the height h of the side wall 19 facing the beating-up mechanism A gradually increases from he tip 18 towards the rear wall of the body, this condition being optional for the side wall 20.

The greatest height *h* of the side wall 19 is in the zone of the smallest spacing 19*c* of this wall from the beating-up mechanism A as shown in FIGS. 3 and 4. It should be noted that the height of the shuttle body in the zone of the cavity 22 (FIG. 5) located at the point of conjugation of the side wall 19 with the rear wall 21 is of no importance.

The weft thread shuttles according to the invention operate as follows.

During the normal course of fabric formation in a conventional travelling-wave shedding loom, the shuttles 1 (FIG. 1) are moved each in its own shed 13 by the roller 15 of the chain conveyor 10. During this movement, the weft thread 33 is paid-off from the spool 28, and engaged by the tooth 23 of the intermediate disk 24 which directs the thread into the recess 4 of the disk 3.

The rotating disks 3 feed the thread 33, in a manner known per se, to the fell 6 of fabric 7, and the thread subsequently leaves the recess 4 of the disk 3 and is beaten-up to the fell 6 under the action of the teeth 5 of the disk 3 on the thread 33.

In the case the weft thread 33 (FIG. 2) is not engaged by the tooth 23 of the disk 24, and hence by the recesses 4, the weft thread is laid-in in parallel with the beating-up mechanism A, the teeth 5 of the disks 3, and the teeth 23 cooperate with the thread 33 to space it a part from the beating-up mechanism A at a still greater distance. During the fabric formation, that is upon the changing of the same, this weft thread 33 is interlaced with the warp threads to produce looping. Thus, the size of the shed 13 is materially reduced (FIG. 6). The resulting shed 13*a*, which is shown with dash-and-dot line in FIG. 6, has a considerably smaller size than the shed 13.

Since upon the formation of looping the fabric formation process is not interrupted, this looping is in the path of movement of the next shuttle 1*a* (FIG. 2) moving in the next shed.

This next shuttle 1*a* enters the reduced shed 13*a* with its tip 18, but due to the fact that the surface of the tip 18 is smoothly conjugated with the side wall 19 facing the beating-up mechanism and is arranged at an acute angle $\alpha$ to the imaginary line 31, that is to the beating-up mechanism A, this shuttle 1*s* gradually penetrates into this reduced shed 13*a* during the movement (FIG. 4) to widen the warp threads and enlarge the shed 13*a* up to the intial size thereof to ensure a free passage of the shuttle.

Thus, the warp threads 12 are widened by the side wall 19 of the body of the shuttle 1*a* which acts on the same threads 12 by different portions of the edge of the side wall 19 at every next instant during the movement. Accordingly, at each of these portions there is developed a force P (FIG. 2) which can be resolved into two component forces $P_1$ and $P_2$.

The force $P_2$ acting on the warp threads normally thereto, that is in the direction of the shuttle movement, is considerably smaller than the force $P_2$ acting on the weft threa 33 normally thereto. Under the action of the force $P_2$, the weft thread 33 interlaced with the warp threads 12 will be displaced by these threads towards the beating-up mechanism A in the direction indicated by arrow D (FIG. 4). This displacement of the weft thread 33 is facilitated by a gradual increase of the height *h* of the side wall 19 from the tip 18 to the rear wall 21 since the warp threads will pass around gradually raising wall of the shuttle during the movement thereof. Since the warp threads 12 are tensioned, elastic forces appearing due to the flexing of the warp threads 12 will tend to straighten them, whereby the weft thread 33 will be displaced under the action of the warp threads 12 towards the beating-up mechanism A. Since the side wall 19 has a largest height at a minimal spacing from the beating-up mechanism A, the weft thread 33 will enter the zone of action of the teeth 23 of the disks 24 during its displacement towards the beating-up mechanism and will be engaged by those teeth, and together with a weft thread 34 (FIG. 2) laid-in by the next shuttle 1*a*, will enter the recess 4 of the disks 3 (FIG. 1). The both threads 33 and 34 are displaced in the above-described manner to the fell 6 of fabric 7 and beaten-up thereto. Therefore, the fabric formation is not interrupted, and there is no undergrade fabric produced since the weft threads 33 and 34 are located each in its own shed and interlaced with the warp threads.

What is claimed is:

1. A weft thread shuttle for travelling-wave shedding looms movable in a shed of the loom along a beating-up mechanism thereof comprising: a body of a trapezoidal cross-section having top and bottom sides, a rear wall and side walls; one of said side walls facing said beating-up mechanism and having leading and trailing surface portions with respect to the direction of movement of the weft thread shuttle; a bevel tip of said body smoothly conjugated with said side wall of the body facing said beating-up mechanism, the distance between said side wall facing said beating-up mechanism and said beating-up mechanism gradually decreasing from said bevel tip towards said rear wall and assuming the smallest value at an intermediate portion thereof in the region of said trailing surface portion; a cavity in the body on the top side thereof; a spool with a weft stock mounted in said cavity of the body; means for tensioning the weft thread paid-off from said spool during its laying-in in said shed in face of the beating-up mechanism, said means being accommodated adjacent to the rear wall of the body and spaced apart from said beating-up mechanism at a distance not exceeding the spacing therefrom of said tip of the body; said leading and trailing surface portions of said side wall facing said beating-up mechanism being respectively arranged at greater and smaller acute angles with respect to an imaginary line extending in parallel with the direction of the shuttle in the shed and said side wall having a height gradually increasing from said tip towards the rear of the body and having a maximum height at said intermediate portion.

2. A shuttle according to claim 1, wherein said side wall of the body facing said beating-up mechanism and the surface of said bevel tip are smoothly conjugated therewith to define a unique convex line whose convexity faces said beating-up mechanism.

3. A shuttle according to claim 1, wherein said leading and trailing side wall surface portions are each straight and define along the entire lengths thereof one of said respective greater and smaller acute angles.

4. A shuttle according to claim 1, wherein said side wall is continuously curved, and said leading and trailing side wall surface portions are each curved and are smoothly conjugated with each other to define continuously smaller acute angles with respect to said imaginary line at points of said side wall starting at said leading surface portion and terminating at said trailing surface portion.

* * * * *